US008422895B2

(12) United States Patent
Takahashi

(10) Patent No.: US 8,422,895 B2
(45) Date of Patent: Apr. 16, 2013

(54) IMAGE FORMING APPARATUS

(75) Inventor: Osamu Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 531 days.

(21) Appl. No.: 12/714,005

(22) Filed: Feb. 26, 2010

(65) Prior Publication Data

US 2010/0221025 A1 Sep. 2, 2010

(30) Foreign Application Priority Data

Feb. 27, 2009 (JP) ..... 2009-046656

(51) Int. Cl.
*G03G 15/00* (2006.01)

(52) U.S. Cl.
USPC ..... 399/49

(58) Field of Classification Search ..... 399/49
See application file for complete search history.

(56) References Cited

U.S. PATENT DOCUMENTS

| | | | | |
|---|---|---|---|---|
| 6,462,821 | B1 * | 10/2002 | Borton et al. | 356/446 |
| 2003/0049039 | A1 | 3/2003 | Suzuki | |
| 2006/0198648 | A1 * | 9/2006 | Itagaki | 399/49 |
| 2007/0019976 | A1 | 1/2007 | Watanabe et al. | |
| 2009/0129801 | A1 * | 5/2009 | Donaldson | 399/49 |

FOREIGN PATENT DOCUMENTS

| | | | |
|---|---|---|---|
| JP | 2000-267369 | A | 9/2000 |
| JP | 2003-098798 | A | 4/2003 |
| JP | 2003-202710 | A | 7/2003 |
| JP | 2004-038091 | A | 2/2004 |
| JP | 2006-178396 | A | 7/2006 |

OTHER PUBLICATIONS

Japan Patent Office, Decision of Patent Grant for Japanese Patent Application No. 2009-046656 (counterpart to above-captioned patent application), dispatched Nov. 8, 2011.

* cited by examiner

*Primary Examiner* — David Gray
*Assistant Examiner* — Sevan A Aydin
(74) *Attorney, Agent, or Firm* — Baker Botts L.L.P.

(57) ABSTRACT

An image forming apparatus is provided. The image forming apparatus includes, a carrier element, an image forming unit, a patch mark generation unit, a specular reflected light detection unit that detects light irradiated onto the carrier element by the irradiation unit and specularly-reflected by the carrier element or patch marks, and a diffuse reflected light detection unit that detects the light irradiated onto the carrier element by the irradiation unit and diffusely-reflected by the carrier element or the patch marks. Additionally, the image forming apparatus includes, a correction unit that corrects at least one of a value detected by the specular reflected light detection unit and the diffuse reflected light detection unit, a correction condition determination unit that determines correction conditions for the correction unit, and a density calculation unit that calculates a density of a patch mark.

9 Claims, 16 Drawing Sheets

IMAGE FORMING APPARATUS

CROSS-REFERENCE TO RELATED APPLICATIONS

This application claims priority from Japanese Patent Application No. 2009-046656 filed on Feb. 27, 2009, the entire contents of which are incorporated herein by reference.

TECHNICAL FIELD

The present invention relates to an image forming apparatus having an image forming unit that produces an image by transferring developer of a plurality of colors and, more particularly, to an image forming apparatus that produces patch marks on a carrier element that rotates in synchronism with an image forming action of the image forming unit, thereby determining image forming conditions for the image forming unit.

BACKGROUND

With respect to a color image forming apparatus, it has previously been conceived to produce patch marks in respective colors on a carrier element (such as a conveying belt) that rotates in synchronism with an operation of an image forming unit (such as a process cartridge), and to correct image density of respective colors by detecting densities of the patch marks. In an image forming apparatus of this type, the densities of the patch marks are calculated by individually detecting specular reflected light and diffuse reflected light from the patch marks. Further, correcting a detected value of diffuse reflected light in accordance with a ratio between specular reflected light and diffuse reflected light reflected by an area having high density.

However, when a correction coefficient is calculated by using patch marks of one density type made in a high density area, there will arise a situation where the influence of stray light, and the like, cannot be eliminated as described below. For example, in the case of a structure having a light emitting element for irradiating a carrier element with light, a first light receiving element for detecting the specular reflected light, and a second light receiving element for detecting the diffuse reflected light, each fixedly inserted into a resin member respectively, the back sides of each of the light emitting element and the light receiving elements are opened, and light can sometimes escape toward the rear of the back sides (i.e., the direction opposite to the carrier element). When some of the escaped light, (also-called stray light) enters any of the light receiving elements, a received light output will occur even when incident light originating from the carrier element is zero. In such a case, values detected by the light receiving elements are shifted on the whole. Thus, it is impossible to sufficiently eliminate the influence of stray light by using only calculating a correction coefficient based on the ratio between specular reflected light and diffuse reflected light from the patch marks of one density type. Moreover, a component of stray light is dependent on the quantity of light emitted by an irradiation unit. Therefore, when the quantity of emitted light is increased by any one of a change in a use environment, a change in an apparatus with time, and the like, the error in the measurements will increase.

Accordingly, an exemplary embodiment of the present invention may make it possible for an image forming apparatus, which produces chromatic color patch marks on a carrier element and detects specular reflected light and diffuse reflected light from the patch marks, to eliminate the influence of stray light from detected values of the specular reflected light and the diffuse reflected light and to thereby accurately detect a density. However, embodiments of the present invention need not solve this or any other problems.

SUMMARY

In view of the above problem, an image forming apparatus according to an exemplary embodiment of the present application comprises: a carrier element that carries developers, an image forming unit that transfers the developers to the carrier element, a patch mark generation unit that controls the image forming unit to generate, a first patch mark which is formed by adhering a developer of a first color at a 100% density level onto the carrier, a second patch mark which is formed by superposing a layer which is formed by adhering a developer of a second color at a 100% density level onto a layer which is formed by adhering the developer of the first color at a 100% level onto the carrier, and a third patch mark which is produced at a 100% density level or less, an irradiation unit, that irradiates light onto the carrier element, a specular reflected light detection unit that detects the light irradiated onto the carrier element by the irradiation unit and specularly-reflected by the carrier element or the patch marks, wherein a first specular detected value is a value of the light which is reflected at the first patch mark and which is detected by the specular reflected light detection unit, a second specular detected value is a value of the light which is reflected at the second patch mark and which is detected by the specular reflected light detection unit, a third specular detected value is a value of the light which is reflected at the third patch mark and which is detected by the specular reflected light detection unit, a diffuse reflected light detection unit that detects the light irradiated onto the carrier element by the irradiation unit and diffusely-reflected by the carrier element or the patch marks, wherein a first diffuse detected value is a value of the light which is reflected at the first patch mark and which is detected by the diffuse reflected light detection unit, a second diffuse detected value is a value of the light which is reflected at the second patch mark and which is detected by the diffuse reflected light detection unit, a third diffuse detected value is a value of the light which is reflected at the third patch mark and which is detected by the diffuse reflected light detection unit, a correction unit that corrects at least one of the values detected by the specular reflected light detection unit and the values detected by the diffuse reflected light detection unit, a correction condition determination unit that determines correction conditions for the correction unit so that the first specular detected value coincides with the first diffuse detected value, and the second specular detected value coincides with the second diffuse reflected value, and a density calculation unit that calculates a density of the third patch mark based on the third specular detected value and the third diffuse detected value, which have been corrected by the correction unit under the correction conditions determined by the correction condition determination unit, wherein the image forming unit determines image forming conditions based on the density calculated by the density calculation unit and forms an image.

Additionally, an image forming apparatus according to an exemplary embodiment of the present application comprises: a carrier that carries a developer image, an image forming unit that transfers developers to the carrier so as to form the developer image, a light source that irradiates light in a direction identical to an optical axis of the light source, the optical axis of the light source intersects with a surface of the carrier at a first position, a first light sensor which is placed so that an angle between the optical axis of the light source and the surface of the carrier coincides with an angle between an optical axis of a first light received by the first light sensor and the surface of the carrier, and which outputs a signal indicating an intensity of the first light incoming from the direction of the optical axis of the first light, a second light sensor which is placed in a position different from the first light sensor, wherein an optical axis of a second light received by the second light sensor and the surface of the carrier intersect at the first position, and wherein the second light sensor outputs a signal indicating an intensity of the second light incoming from the direction of the optical axis of the second light; and a controller which is coupled to the image forming unit, the light source, the first light sensor, and the second light sensor, wherein the controller calculates correction values which correct output signals of the first and second light sensors, the correction values are calculated by, controlling the image forming unit to form a patch mark, wherein the patch mark is formed by adhering a developer of a first color onto the carrier as a first developer layer, and by adhering a developer of a second color onto the first developer layer as a second developer layer, controlling the irradiation unit to irradiate light onto the patch mark which is formed on the carrier, reading patch mark signals which are signals outputted by the first and second light sensors when the light is irradiated onto the patch mark, and calculating the correction values which correct the intensities indicated by output signals of the first and second light sensors based on the patch mark signals.

DESCRIPTION

An exemplary embodiment of the present invention is now described by reference to the drawings. The exemplary embodiment described below relates to an application of the present invention to a laser printer used while connected to a computer.

1. Appearance and Structure of the Laser Printer

Figure 1:
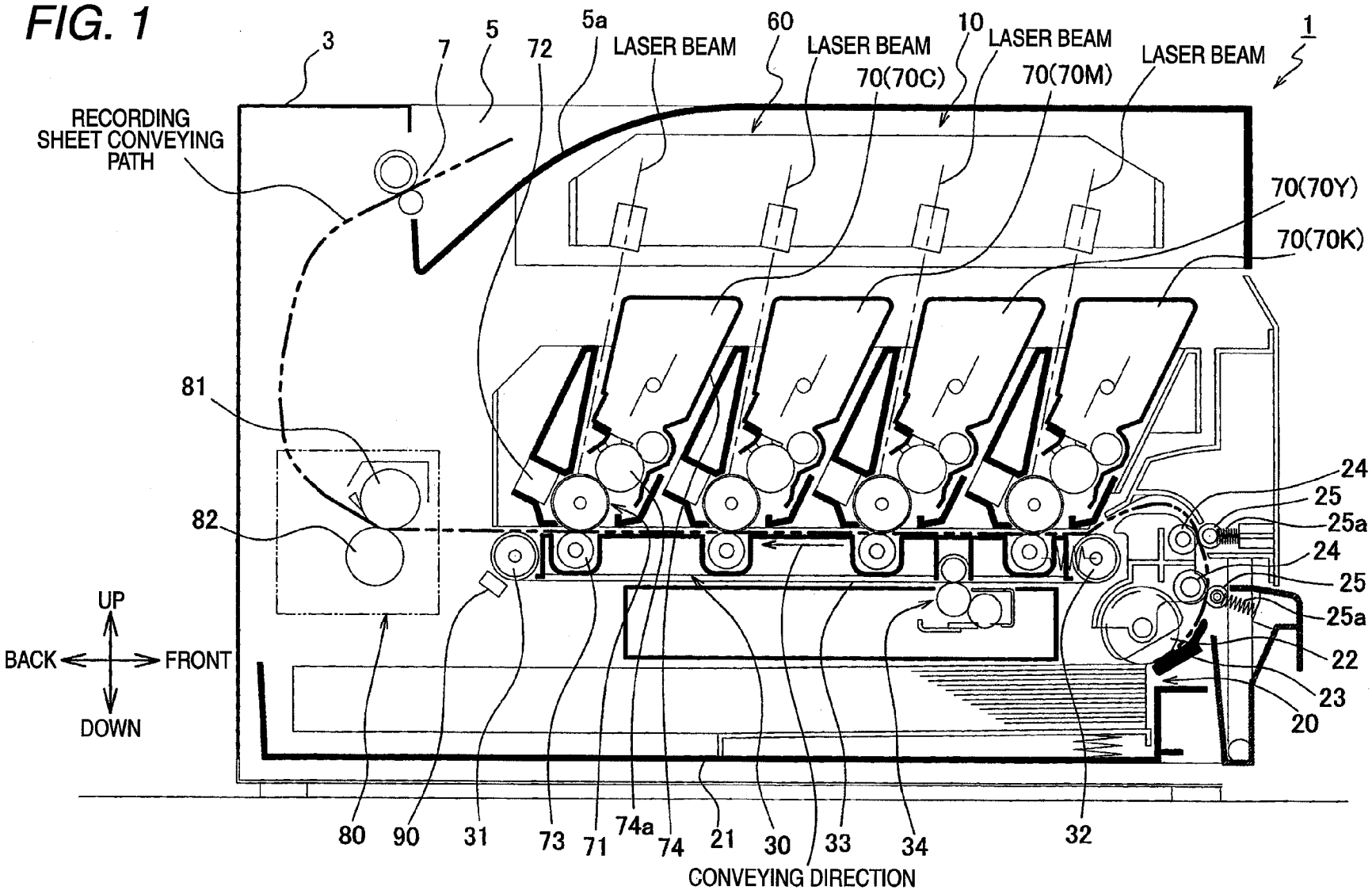
FIG. 1 is a side cross-sectional view showing a general structure of a laser printer to which an exemplary embodiment of the present invention is applied.

Viewing FIG. 1 lengthwise, the laser printer 1 is showed with the topside FIG. 1 being taken as the top of the printer. Further, the laser printer is shown with the right side of FIG. 1 being taken as a front side. A housing 3 of the laser printer 1 is formed in a substantially-box-shaped geometry (a cubic shape). A sheet output tray 5 on which paper ejected out of the housing 3 after completion of printing and a recording sheet (an example of a recording medium), such as an OHP sheet, is loaded, is provided on an upper surface side of the housing 3.

In the present embodiment, a frame member made of metal, resin, or the like, (omitted from illustrations) is provided in the housing 3. Process cartridges 70, a fixing unit 80, and the like, are removably attached to the frame member disposed in the housing 3 and which will be described later.

The sheet output tray 5 comprises a sloped surface 5*a* that is inclined so as to decline from an upper surface of the housing 3 with a height which increases in a rearward direction. An output section 7 to which a recording sheet, which has finished being printed is output, is provided at a rear end side of the sloped surface 5*a*.

2. Internal Mechanical Structure of the Laser Printer

The image forming section 10 is part of the image forming unit that produces an image on a recording sheet. A feeder section 20 feeds a recording sheet to the image forming section 10. A conveying mechanism 30 corresponds to the conveying unit, which conveys a recording sheet so as to pass through an area opposite four process cartridges 70K, 70Y, 70M, and 70C, which make up the image forming section 10.

A print density sensor 90 is an example of the patch mark reading unit, which detects patch marks produced on a surface of a conveying belt 33 acting, which is an example of the carrier element to be described later. A conveying direction of a recording sheet having finished undergoing image formation in the image forming section 10 is turned upside by an output chute (omitted from the drawings) and ejected out of the output section 7 to the sheet output tray 5.

2.1. Structure of the Feeder Section

The feeder section 20 is comprises a sheet feeding tray 21 housed in the bottom of the housing 3; a sheet feed roller 22 provided at a position above the front end of the sheet feeding tray 21, and the sheet feed roller 22 feeds a recording sheet loaded on the sheet feeding tray 21 to the image forming section 10; and a separation pad 23 disposed at a location opposing the sheet feed roller 22, and the separation pad 23 that separates the recording sheets one by one by imparting predetermined conveying resistance to the recording sheet.

Each of the recording sheets loaded on the sheet feed tray 21 makes a U-turn at a front side area in the housing 3 and is conveyed to the image forming section 10 located at substantially the center of the housing 3. Therefore, a region of a recording sheet conveying path extending from the sheet feed tray 21 to the image forming section 10, where the sheet undergoes substantially-U-shaped turnaround, is provided with a conveying roller 24 that imparts conveying force to the recording sheet conveyed to the image forming section 10 while curved in a substantially-U-shaped form.

A press roller 25 that presses a recording sheet against the conveying roller 24 is disposed at a location opposing the conveying roller 24 with the recording sheet sandwiched therebetween. The press roller 25 is pressed toward the conveying roller 24 by elastic means, such as a coil spring 25*a*.

2.2. Structure of the Conveying Mechanism

The conveying mechanism 30 comprises a drive roller 31 that rotates in synchronism with operation of the image forming section 10; a driven roller 32 that is rotatably placed at a position spaced apart from the drive roller 31; a conveying belt 33 that is stretched between the drive roller 31 and the driven roller 32. By rotating the conveying belt 33 while carrying a recording sheet, the recording sheet is conveyed from the sheet feed tray 21 sequentially to the four process cartridges 70K, 70Y, 70M, and 70C. A belt cleaner 34 for erasing patch marks, which will be described later, produced on the surface of the conveying belt 33 is disposed beneath the conveying belt 33.

2.3. Structure of the Image Forming Section

The image forming section 10 comprises a scanner section 60, the process cartridge 70, and the fixing unit 80. The image forming section 10 of the present embodiment is able to perform color printing of a so-called direct tandem type. In the present embodiment, the four process cartridges 70K, 70Y, 70M, and 70C corresponding to toner (developers) of four colors are arranged, in sequence, from an upstream position in the direction of conveyance of the recording sheet. In other words, black, yellow, magenta, and cyan process cartridges are aligned in series along the direction of conveyance of the recording sheet. The four process cartridges 70K, 70Y, 70M, and 70C each differ from one another only in terms of toner color and are identical in all other respects. The four process cartridges 70K, 70Y, 70M, and 70C are generically referred to hereafter as the process cartridge 70.

The scanner section 60 is provided at an upper position within the housing 3 and produces electrostatic latent images on surfaces of respective photosensitive drums 71 that are assigned respectively to the four process cartridges 70K, 70Y, 70M, and 70C and that represent an example of electrostatic latent image carrier elements. Specifically, the scanner section 60 comprises laser light sources, polygon mirrors, fθ lenses, and reflection mirrors, for example.

The process cartridge 70 is disposed so as to be removably attached into the housing 3 at a position below the scanner section 60. Each process cartridge 70 comprises a photosensitive drum 71, a charger 72, a transfer roller 73, and a development cartridge 74.

The fixing unit 80 is disposed at a downstream position with respect to the photosensitive drums 71 in the direction of the conveying path of the recording sheet. The fixing unit 80 thermally fuses the toner transferred on a recording sheet to thus fix the toner. Specifically, the fixing unit 80 includes a heat roller 81 that is disposed on a print plane side of a recording sheet and that imparts conveying force to the recording sheet while heating toner; and a press roller 82 that is disposed opposite the heat roller 81 with a recording sheet sandwiched therebetween and that presses the recording sheet against the heat roller 81.

The image forming section 10 produces an image on a recording sheet as follows. Specifically, the surface of each of the photosensitive drums 71 is uniformly, positively charged by a corresponding charger 72 when the photosensitive drum is rotated. Subsequently, the charged surface is exposed to a laser beam emitted from the scanner section 60 using a high-speed scan. An electric potential of the exposed area becomes lower than an electric potential of the unexposed area, and thus an electrostatic latent image corresponding to an image to be produced on a recording sheet is made in the exposed areas of the surface of the photosensitive drum 71.

Subsequently, a development bias is applied to a development roller 74*a* while the development roller 74*a* provided in the development cartridge 74 is rotated, whereby the toner, which is held over the development roller 74*a* and which is positively charged, is supplied to the electrostatic latent image produced on the surface of the corresponding photosensitive drum 71 when contacting the photosensitive drum 71 in an opposing manner. Thus, toner is supplied to the exposed area whose electric potential was lowered by exposing the uniformly, positively charged surface of the photosensitive drum 71 with the laser beam. The electrostatic latent image on the photosensitive drum 71 is thereby visualized, and a toner image made through reversal development is held on the surface of the photosensitive drum 71.

Subsequently, the toner image held on the surface of the photosensitive drum 71 is transferred to a recording sheet using a transfer bias applied to a corresponding transfer roller 73. The recording sheet onto which the toner image has been transferred is conveyed to the fixing unit 80, where the sheet is heated, to fix the toner, which has been transferred as the toner image, to the recording sheet. Thus, generation of an image (printing operation) is completed.

2.4 Structure of a Print Density Sensor

Figure 2:
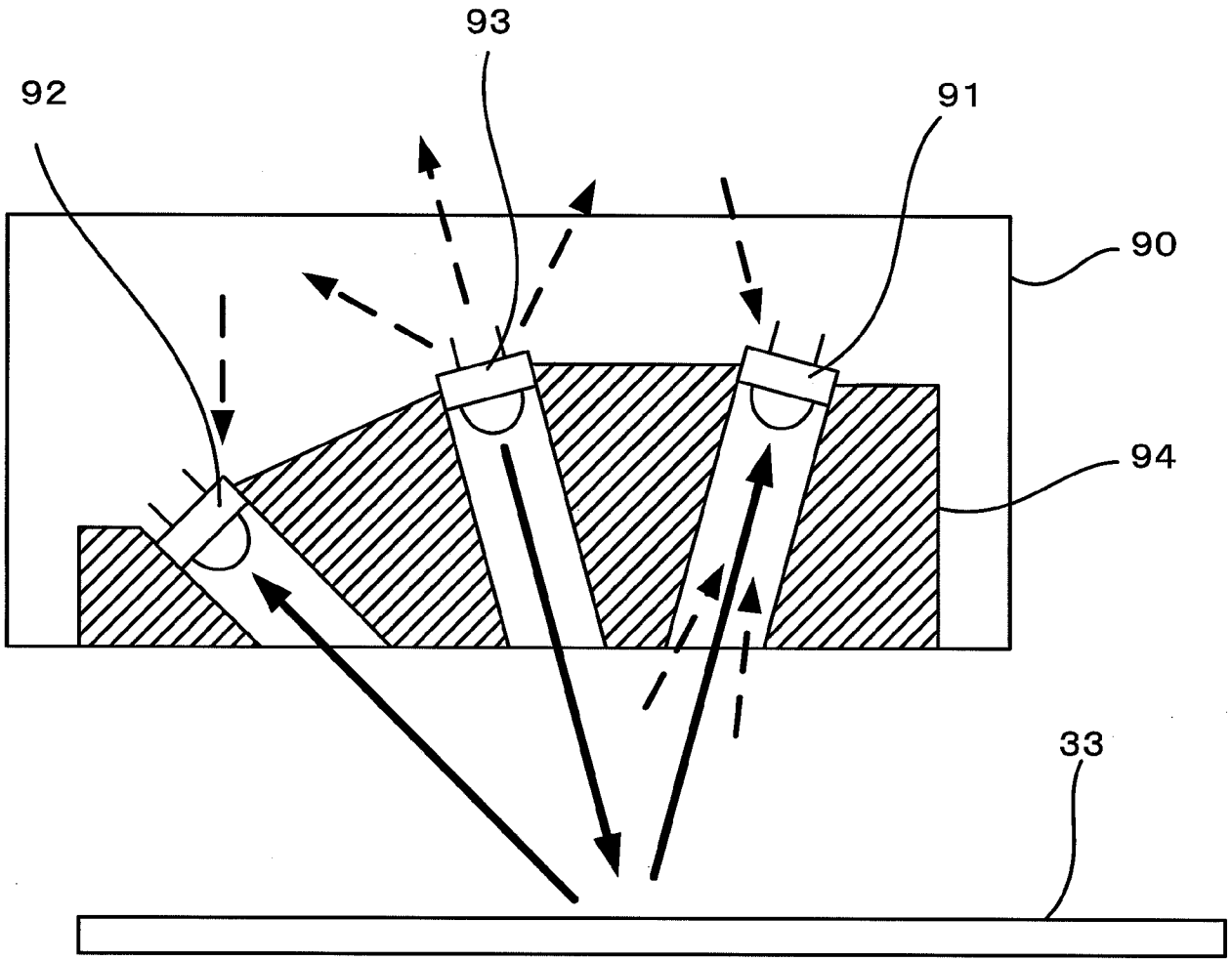
FIG. 2 is a descriptive view showing a general structure of a print density sensor of the laser printer.

As shown in FIG. 2, a print density sensor 90 comprises a light emitting element 93, which includes an LED and which is an example of an irradiation unit for irradiating the conveying belt 33 with infrared radiation; a specular reflected light-receiving element 91, which is an example of a specular reflected light detection unit for detecting the quantity (intensity) of infrared light specularly-reflected at an angle identical with an incident angle of the infrared light emitted to the conveying belt 33 from the light emitting element 93; and a diffuse reflected light-receiving element 92, which serves as an example of a diffuse reflected light detection unit for detecting the quantity (intensity) of light diffusely-reflected at an angle differing from the incident angle of the infrared light emitted to the conveying belt 33 from the light emitting element 93. The respective elements 91 to 93 are each individually fixed and inserted into a resin member 94, and each of elements 91 to 93 has back sides that are opened.

In order to yield an electric characteristic for transferring toner, the conveying belt 33 employs a carbon-dispersed film as a belt material. Therefore, a surface of the conveying belt 33 is black and absorbs infrared radiation so as to hardly cause diffuse reflection. However, the surface of the conveying belt 33 is finished to a high gloss level and, therefore, exhibits characteristics of inducing specular reflection. For this reason, in a state where no patch marks are produced on the conveying belt 33, the specular reflected light-receiving element 91 detects infrared radiation, and the diffuse reflected light-receiving element 92 hardly detects any infrared radiation.

Figure 3:
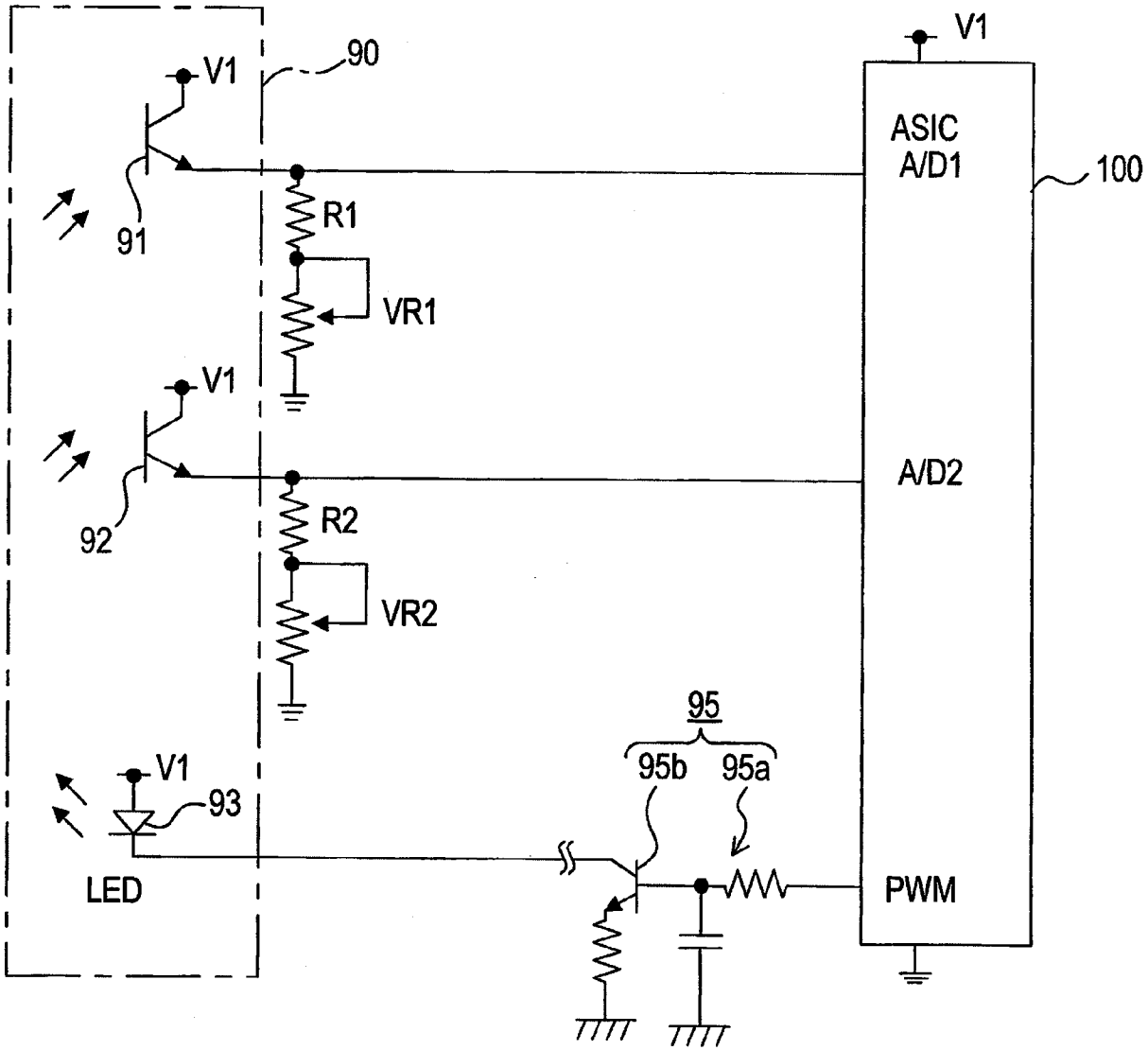
FIG. 3 is a circuit diagram showing an electrical configuration of the print density sensor.

As shown in FIG. 3, an electric current flowing into the light emitting element 93 is regulated by a light quantity regulation circuit 95 that is controlled in accordance with a PWM signal output from a PWM port of an ASIC (Application Specific Integrated Circuit) 100 to be described later. Specifically, the light quantity regulation circuit 95 has a smoothing circuit 95*a* that smoothes the PWM signal output from the PWM port and a transistor 95*b* that applies a drive current conforming to a smoothed current to the light emitting element 93. The light emitting element 93 irradiates the conveying belt 33 with a quantity of infrared radiation conforming to a duty ratio of the PWM signal.

The specular reflected light-receiving element 91 comprises a phototransistor that has a collector connected to a DC power source V1 and an emitter grounded by way of a fixed resistor R1 and a variable resistor VR1. An electric current conforming to the quantity of received light is applied to the specular reflected light-receiving element 91. Therefore, as the quantity of received light increases, a voltage depression caused by the fixed resistor R1 and the variable resistor VR1 increases and a voltage of the emitter rises. The voltage of the emitter is input to an analogue input terminal A/D1 of the ASIC 100. Likewise, the diffuse reflected light-receiving element 92 comprises a phototransistor that has a collector connected to the DC power source V1 and an emitter grounded by way of a fixed resistor R2 and a variable resistor VR2. An electric current conforming to the quantity of received light is applied to the diffuse reflected light-receiving element 92. Therefore, as the quantity of received light increases, a voltage depression caused by the fixed resistor R2 and the variable resistor VR2 increases and the voltage of the emitter rises. The voltage of the emitter is input to an analogue input terminal A/D2 of the ASIC 100.

The variable resistors VR1 and VR2 are adjusted in accordance with sensitivity characteristics of the specular reflected light-receiving element 91 and the diffuse reflected light-receiving element 92. Voltages input to the analogue input terminals A/D1 and A/D2 are regulated so as to fall within a predetermined range. It may also be possible to allow the ASIC 100 to directly change resistance values by using a digital potentiometer instead of the variable resistors VR1 and VR2.

3. Structure of the Control System of the Laser Printer

Figure 4:
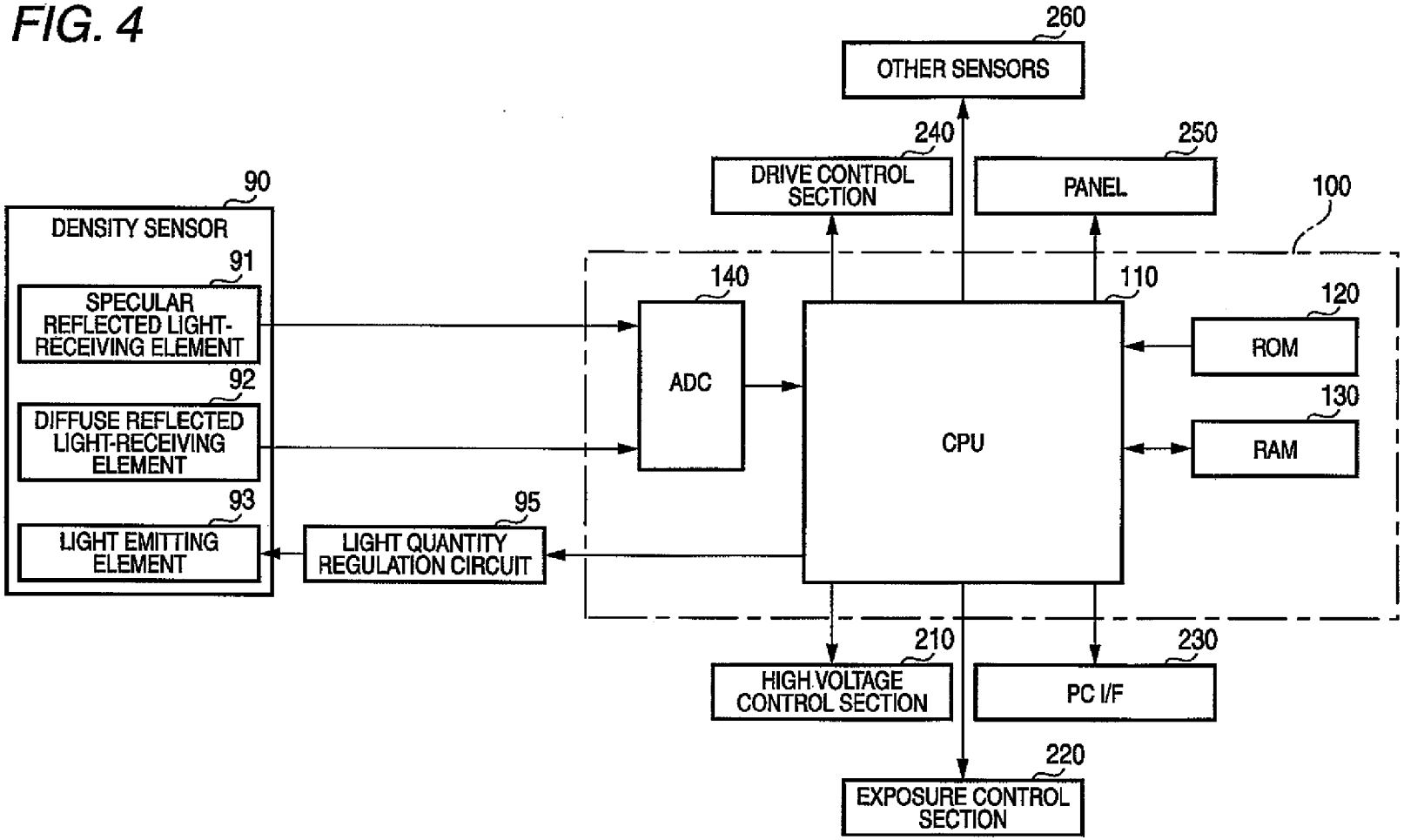
FIG. 4 is a block diagram showing a configuration of a control system of the laser printer.

As shown in FIG. 4, the ASIC 100 has a CPU 110, ROM 120, and RAM 130. The ASIC 100 enables performance of various arithmetic operations. The ASIC 100 additionally has an AD converter (ADC) 140 that converts the voltages input to the foregoing analogue input terminal A/D1 and A/D2 into digital values. The respective voltages (hereinafter also referred to as an output from the specular reflected light-receiving element 91 and an output from the diffuse reflected light-receiving element 92) converted into digital values by the AD converter 140 are input to the CPU 110. The CPU 110 outputs the foregoing PWM signal to the light quantity regulation circuit 95. In addition, the CPU 110 is connected to a high voltage control section 210 that controls the development bias, and the like; an exposure control section 220 that controls laser light sources, and the like, of the scanner section 60; a PC interface (PC I/F) 230 to which data, and the like, is input by an external computer, and the like; a drive control section 240 that drives and controls individual sections of the sheet feed roller 22, and the like; a panel 250 provided on the surface of the housing 3; and other various sensors 260.

4. Control Operation of the Control System

Control operation performed by the CPU 110 in accordance with a program stored in the ROM 120 of the ASIC 100 will now be described.

Figure 5:
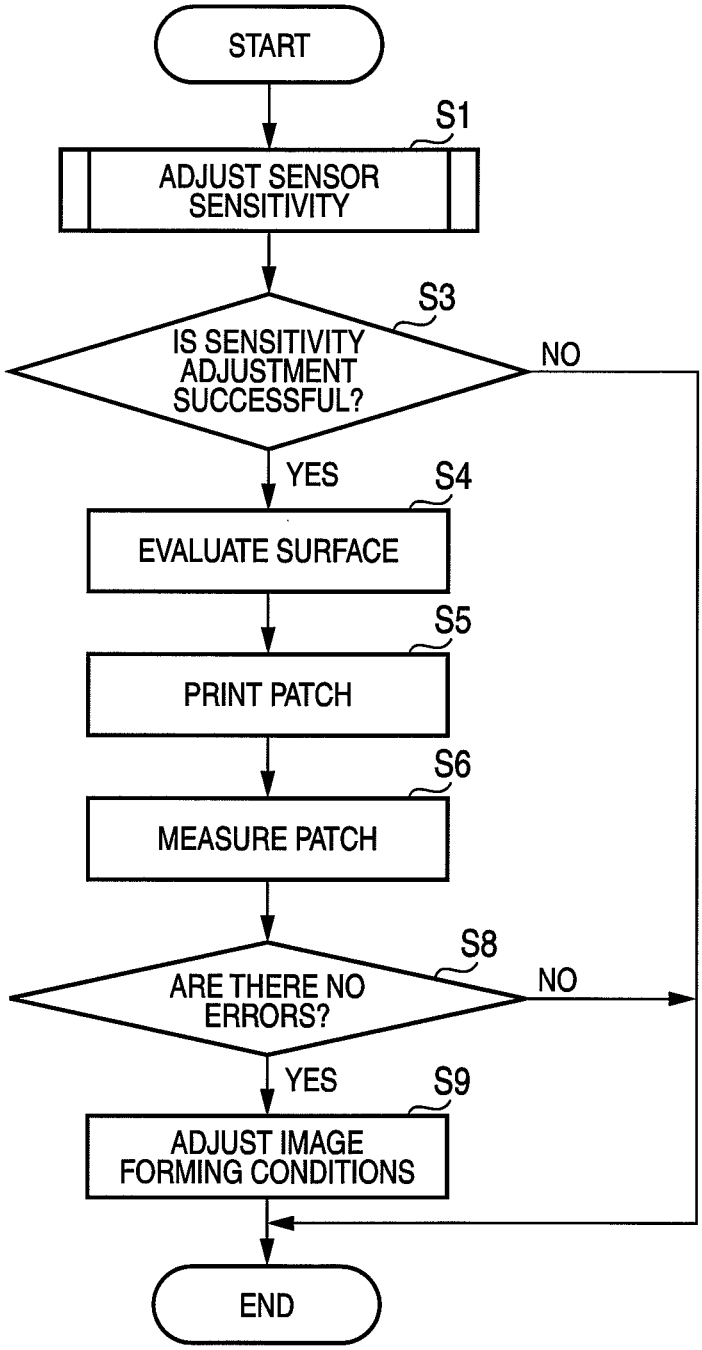
FIG. 5 is a flowchart showing density correction processing that is performed when density correction for making patch marks on the conveying belt is commanded at a known, predetermined timing, at power-on, for instance.

As shown in FIG. 5, when density correction is commanded and processing is commenced, sensor sensitivity adjustment processing, such as that mentioned below, is first performed in Si (reference symbol "S" denotes a step: the same also applies to corresponding expressions).

Figure 6:
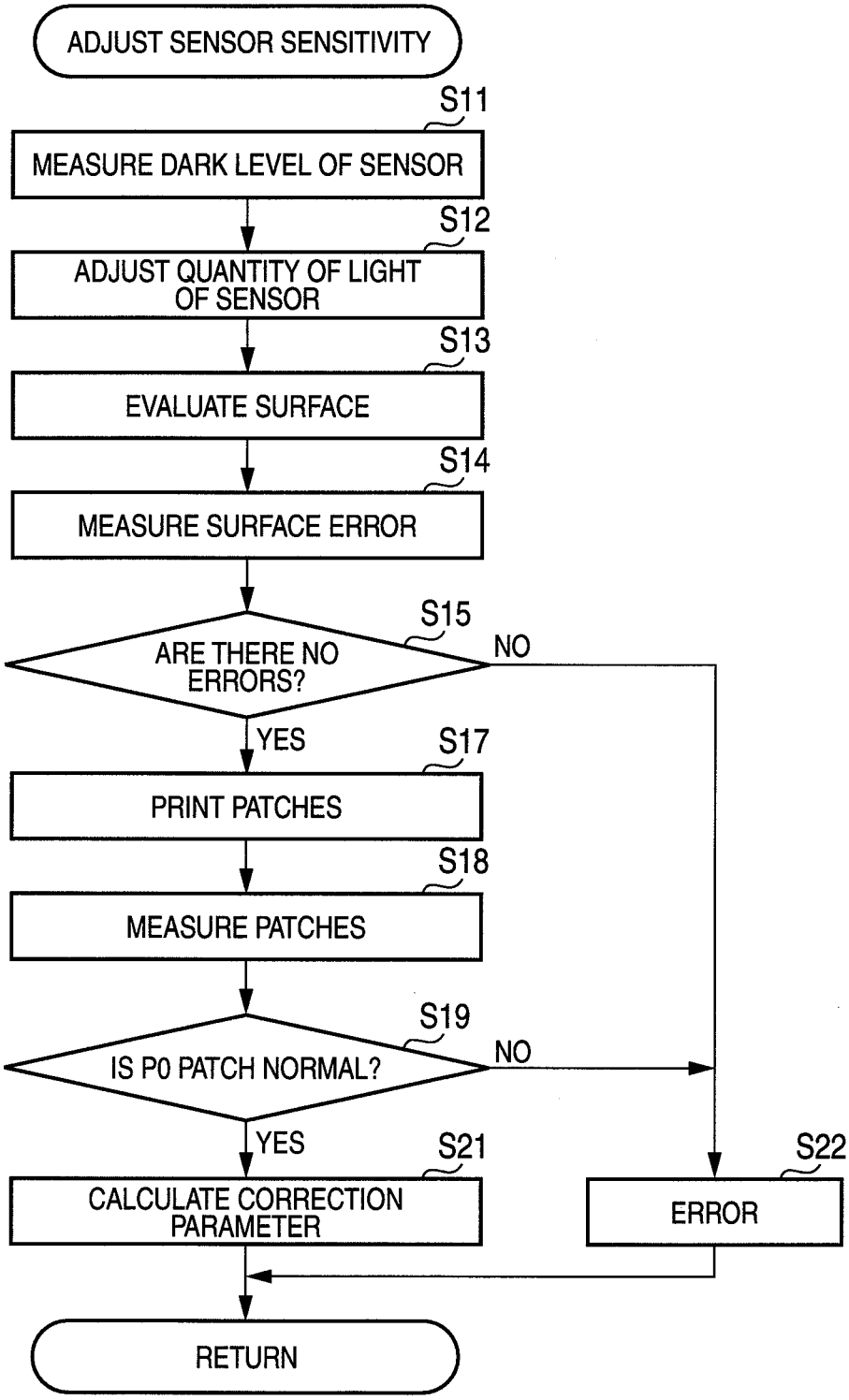
FIG. 6 is a flowchart showing detailed sensor sensitivity adjustment processing in the processing.

As shown in FIG. 6, an output from the specular reflected light-receiving element 91 and an output from the diffuse reflected light-receiving element 92 are first measured in S11 when the light emitting element 93 remains extinguished (a sensor dark level). In S12, the quantity of light of the light emitting element 93 is adjusted in such a way that the light reflected from a surface of the conveying belt 33 falls within a predetermined range. Further, the surface of the conveying belt 33 is evaluated in S13. In the processing of S13, specular reflected light and diffuse reflected light are measured at a plurality of locations on the conveying belt 33, while the conveying belt 33 is rotated. In S14, a surface error determination is made using the measurement results to determine whether any anomalous values were measured. For instance, when an anomalous value is measured through the surface examination of S13, the conveying belt 33 is determined to be stained or flawed, and an error can be determined in S14.

In S15, whether or not an error determination was made in S14 is judged. When no error determination is judged to have been made (Y in S15), processing proceeds to S17 where patch marks are printed by an exemplary embodiment of a patch mark generation unit.

Figure 7:
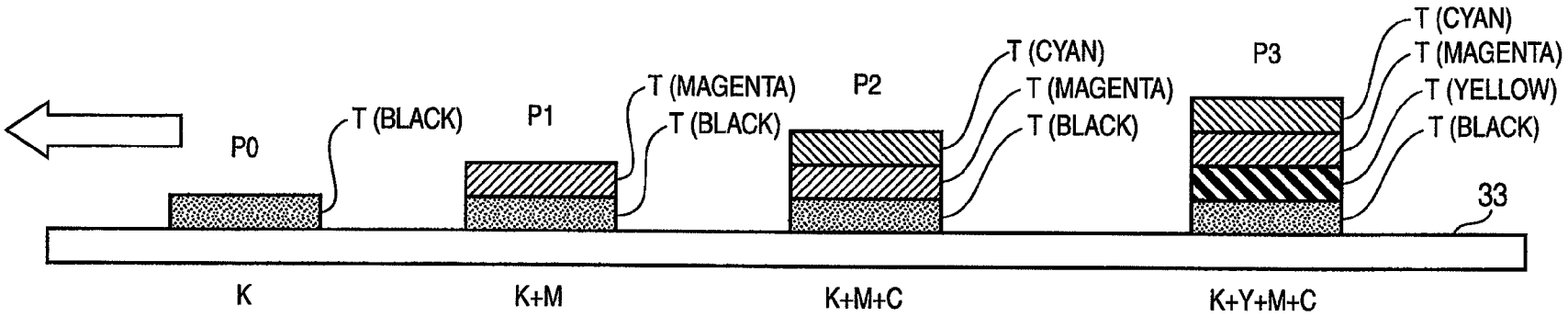
FIG. 7 is a descriptive view showing a configuration of patch marks produced through processing.

As illustrated in FIG. 7, four types of patch marks are produced in S17 and the thus-produced patch marks are printed at positions on the conveying belt 33 whose surface was examined in S13. Specifically, a patch mark (herein below called a "P0 patch") produced by transferring only black (K) toner T at 100% density level; a patch mark (herein below called a "P1 patch") produced by transferring magenta (M) toner T at 100% density level over black (K) toner T having already been transferred at 100% density level; a patch mark (hereinafter called a "P2 patch") produced by transferring in sequence magenta (M) toner T and cyan (C) toner T, each at 100% density level, over black (K) toner T having already been transferred at 100% density level; and a patch mark (hereinafter called a "P3 patch") produced by transferring in sequence yellow (Y) toner T, magenta (M) toner T, and cyan (C) toner T, each at 100% density level, over black (K) toner T having already been transferred at 100% density level, are produced (printed). Here, a density level is calculated based on a ratio of an area to which the developer is adhered divided by an area at which the patch mark is printed. In this specification, the density level is shown by percentage.

Turning back to FIG. 6, the patch marks printed in S17 are measured in S18. Specifically, the respective patch marks are moved to a position opposing the print density sensor 90 by rotating the conveying belt 33, and there is performed a process of reading an output from the specular reflected light-receiving element 91 and an output from the diffuse reflected light-receiving element 92 while the light emitting element 93 is caused to emit the quantity of light regulated in S12. In S19, it is determined whether or not the foregoing P0 patch is normal. When the black (K) toner T was normally transferred at 100% density level, both the diffuse reflected light and the specular reflected light are hardly detected. Therefore, in S19, it is judged whether or not the P0 patch is normal according to whether or not the output from the specular reflected light-receiving element 91 has come to a predetermined value (e.g., 20% of the output pertaining to the surface of the conveying belt 33) or less.

When the P0 patch is normal (Y in S19), correction parameters are calculated in S21, which provides an example of the correction condition determination performed by the correction condition determination unit. After the correction conditions are calculated, sensor sensitivity adjustment processing (S1) is completed, and processing proceeds to S3 in FIG. 5. Conversely, when the P0 patch is not normal (N in S19) and when an error is determined to be present in S15 (N in S15), known error processing, such as storage of an error, is performed in S22, and processing then proceeds to S3 in FIG. 5.

Figure 8A:
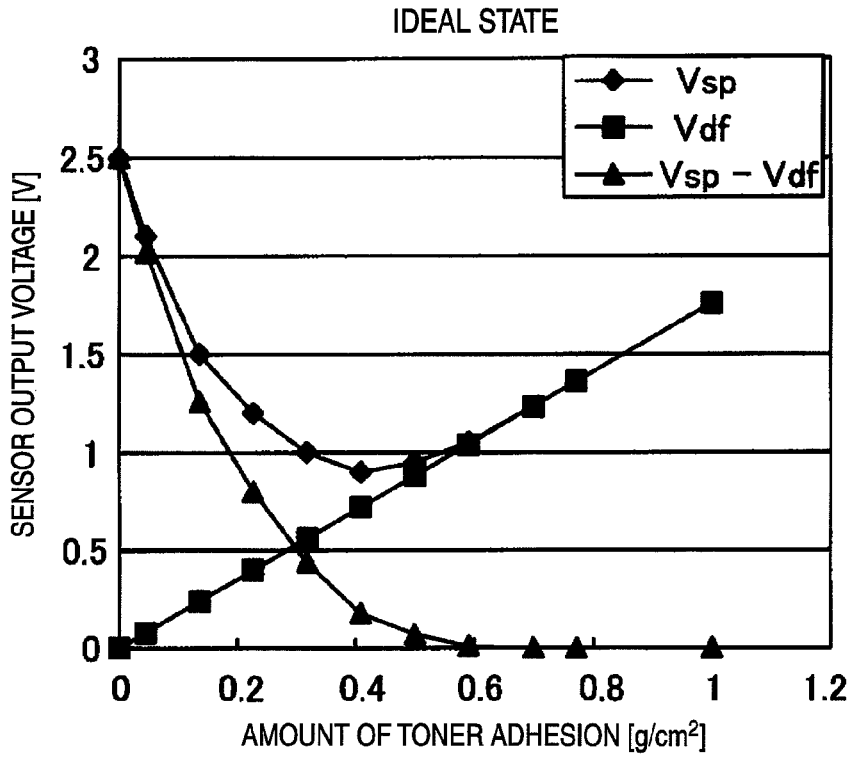
FIG. 8 is a descriptive view showing a problem to be solved by the processing.

A process for calculating correction parameters in S21 will now be described in detail. In an ideal state that is free from stray light, and the like, when patch marks are produced from chromatic color toner, such as magenta (M), yellow (Y), and cyan (C), an output Vsp from the specular reflected light-receiving element 91 and an output Vdf from the diffuse reflected light-receiving element 92 change as illustrated in FIG. 8A.

Specifically, as the quantity of toner adhesion increases, the specular reflected light from the patch marks decreases in an inversely proportional manner, but the diffuse reflected light linearly increases. For these reasons, since the output Vdf corresponds solely to the quantity of diffuse reflected light from the patch marks, the output Vdf increases with an increase in the quantity of toner adhesion. Conversely, the output Vsp corresponds to a total quantity of the diffuse reflected light and the specular reflected light from the patch marks. Therefore, when the quantity of toner adhesion increases as illustrated in FIG. 8A, the output Vsp increases after first temporarily decreasing. In a high density area (the quantity of toner adhesion in the case shown in FIG. 8A is 0.6 g/cm$^2$ or more) where specular reflected light from the patch marks (specifically, infrared radiation specular reflected from the conveying belt 33 after having passed through the patch marks) can be ignored, the outputs become equal to each other (Vsp=Vdf). In this case, the quantity of toner adhesion can be calculated using Vsp-Vdf in regions of various density levels.

Figure 8B:
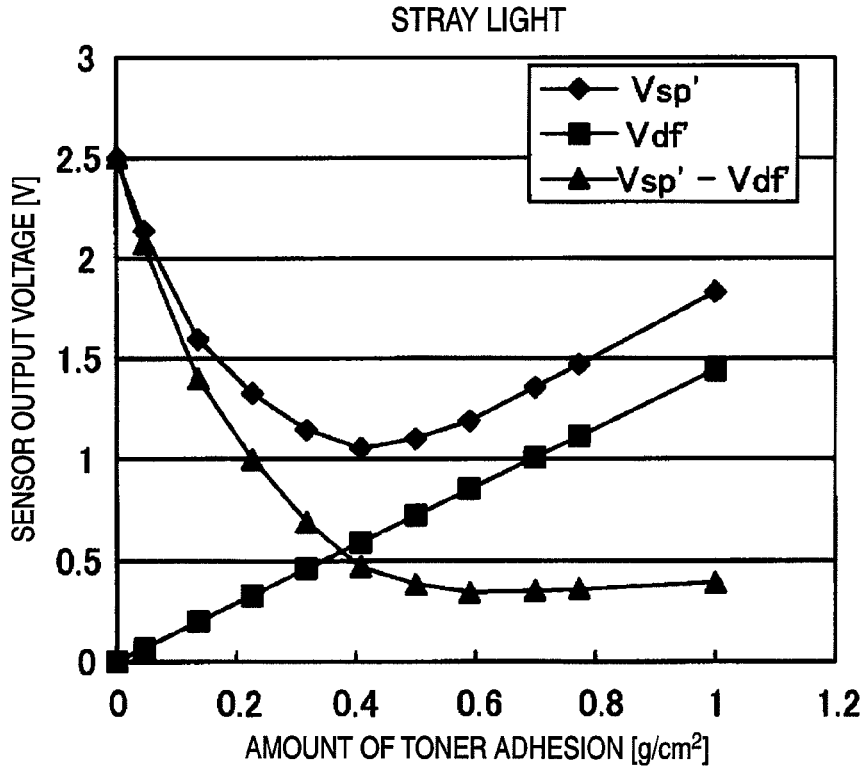

Meanwhile, the specular reflected light-receiving element 91, the diffuse reflected light-receiving element 92, and the light emitting element 93 are, fixedly inserted individually into the resin member 94, and the back sides of each of respective elements 91 to 93 are opened. Therefore, light may escape from the rear of the back sides (i.e., a direction opposite to the conveying belt 33), as illustrated by a broken arrow in FIG. 2. When some of the escaped light, specifically stray light, enters either the receiving element 91 or 92, an output is produced by light receiving element 91 or 92 in spite of incident light originating from the conveying belt 33 being zero. In such a case, the outputs Vsp' and Vdf' become alternately shifted, as represented by Vsp' and Vdf' shown in FIG. 8B, for example, and the quantity of toner adhesion cannot accurately be calculated. However, if a resin member is used to cover the back sides of the elements 91 to 93, respectively, ease of assembly of the print density sensor 90 deteriorates.

Figure 8C:
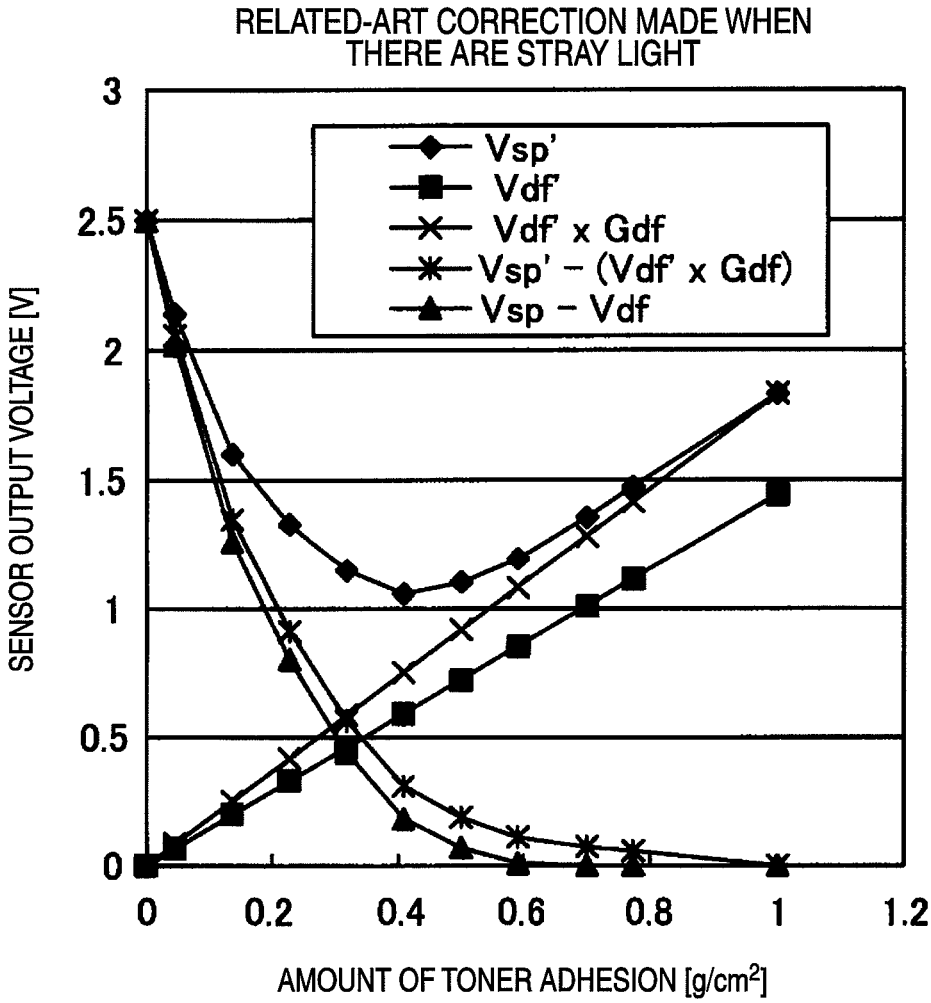

Further, a correction cannot be made to the amount of shift by mere calculation of a correction coefficient from a ratio between specular reflected light and diffuse reflected light from the patch marks of one density type as mentioned in connection with background of the specification. Therefore, the influence of stray light cannot sufficiently be eliminated. For example, even when a correction coefficient Gdf is determined in such a way that the outputs Vsp' and Vdf', which are achieved when the quantity of toner adhesion is 1 g/cm$^2$, match each other as illustrated in FIG. 8C, the result acquired by Vsp'−(Vdr'×Gdf) greatly differs in terms of a waveform from a result acquired by Vsp−Vdf in an ideal state. Thus the quantity of toner adhesion cannot accurately be calculated.

Figure 9A:
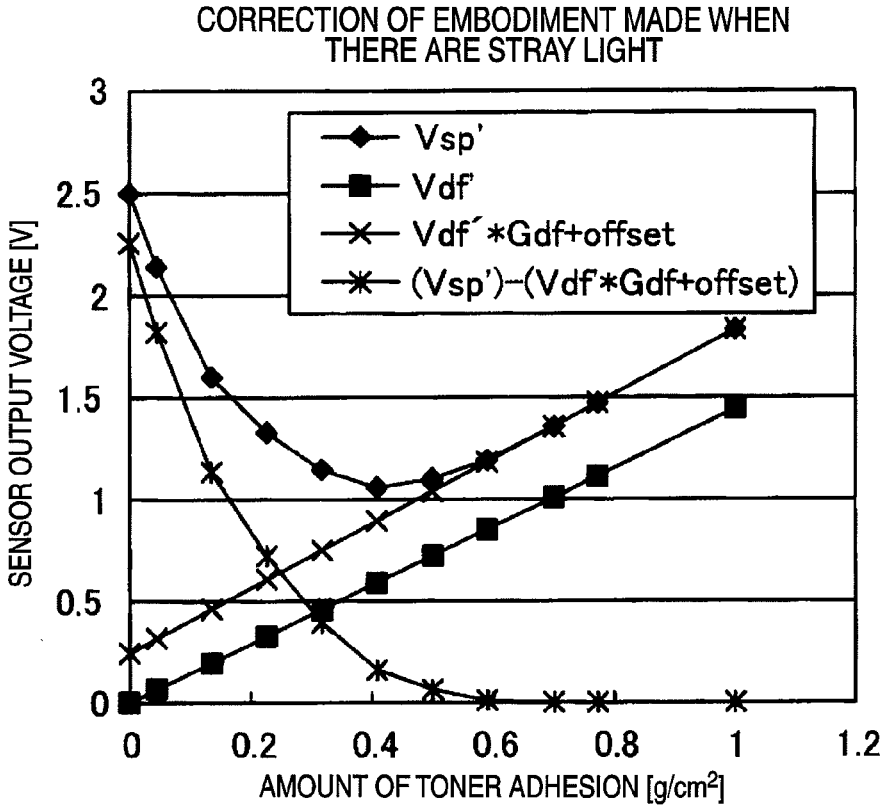
FIG. 9 is a descriptive view showing an effect of the processing.

Accordingly, correction parameters are calculated in S21 in such a way that outputs Vsp (an output Vsp'1 and an output Vsp'2) respectively regarding the P1 patch and the P2 patch in the high density area coincide with the outputs Vdf (an output Vdf'1 and an output Vdf'2) respectively regarding the P1 patch and the P2 patch in the high density area. Specifically, a Gdf serving as a first correction value is calculated by an expression of (Vsp'1−Vsp'2)/(Vdf'1−Vdf'2) (example of the process used by the first calculation unit), and an OFFSET serving as a second correction value is calculated by an expression of Vsp'2−Vdf'2×Gdf (example of the process used by the second calculation unit). The output Vdf' is corrected as Vdf'×Gdf+OFFSET by use of Gdf and OFFSET, thereby a corrected Vdf' (i.e., Vdf'×Gdf+OFFSET) can properly be caused to match the Vsp' in the high density area, as illustrated in FIG. 9A.

Figure 9B:
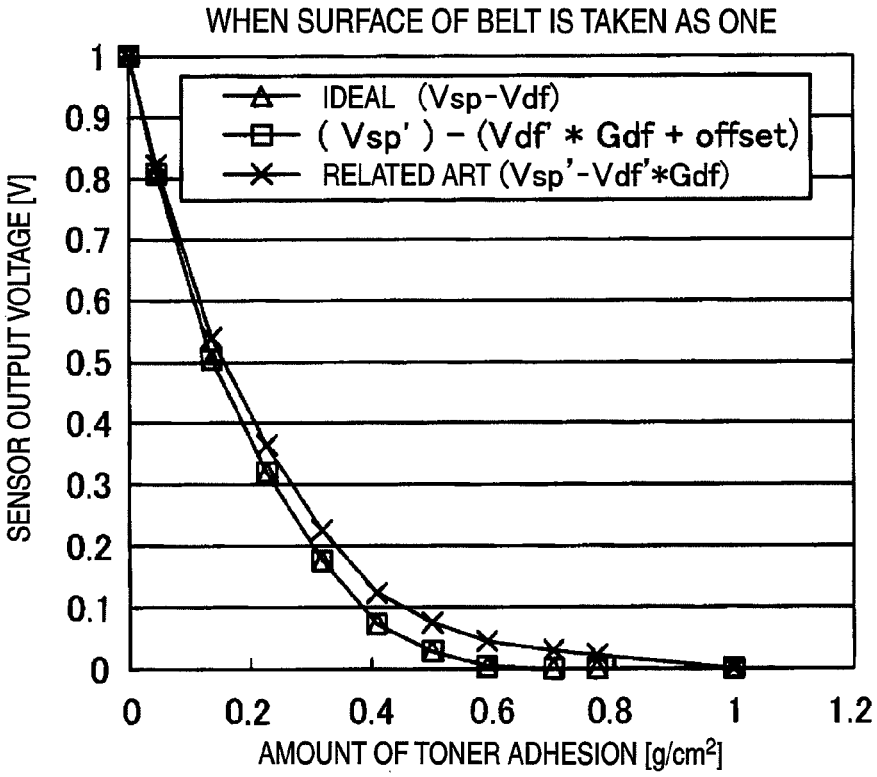

Therefore, as illustrated in FIG. 9B, (Vsp')−(Vdf'×Gdf+OFFSET), the difference between the corrected outputs, properly coincides with Vsp−Vdf, the difference achieved in an ideal state, and therefore the quantity of toner adhesion can accurately be calculated.

Figure 10A:
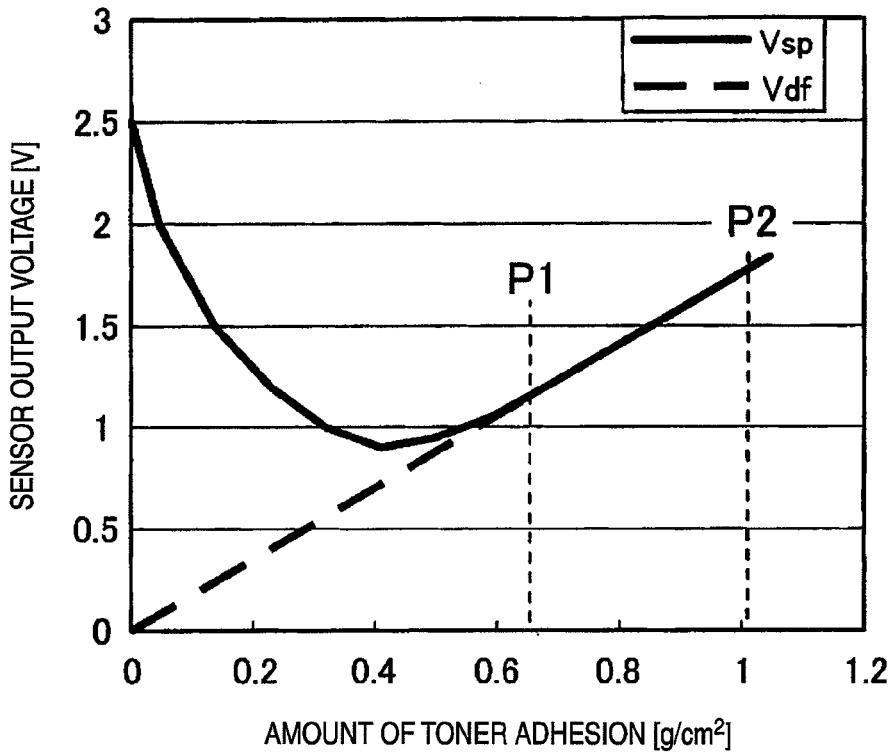
FIG. 10 is a descriptive view showing an effect of generating the patch marks at a high density.
Figure 10B:
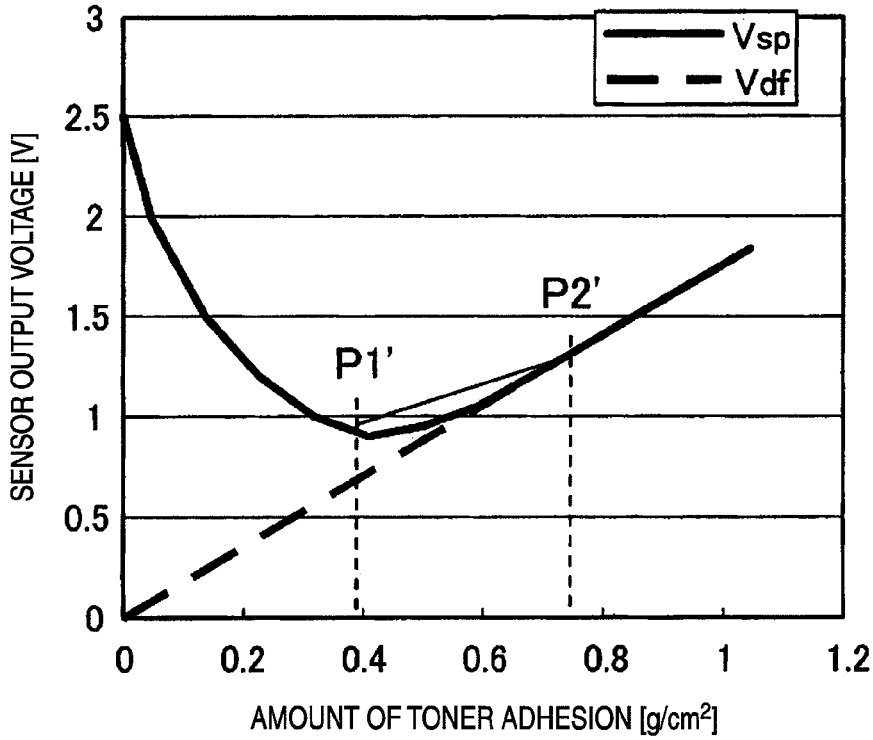

Calculation of such correction parameters Gdf and OFFSET is based on the assumption that the P1 patch and the P2 patch are produced in the high density area. Specifically, as illustrated in FIG. 10A, when both the P1 patch and the P2 patch are produced in the high density area, it is effective to calculate the correction parameter so that the outputs Vsp and Vdf which pertain to the respective patches match each other. Incidentally, as illustrated P1' and P2' in FIG. 10B, if correction parameters for causing the outputs Vsp and Vdf pertaining to the respective patches to match each other are calculated in a case where, for example, the P1 patch (P1') is not produced in the high density area, it will become difficult to accurately calculate the quantity of toner adhesion.

Figure 10C:
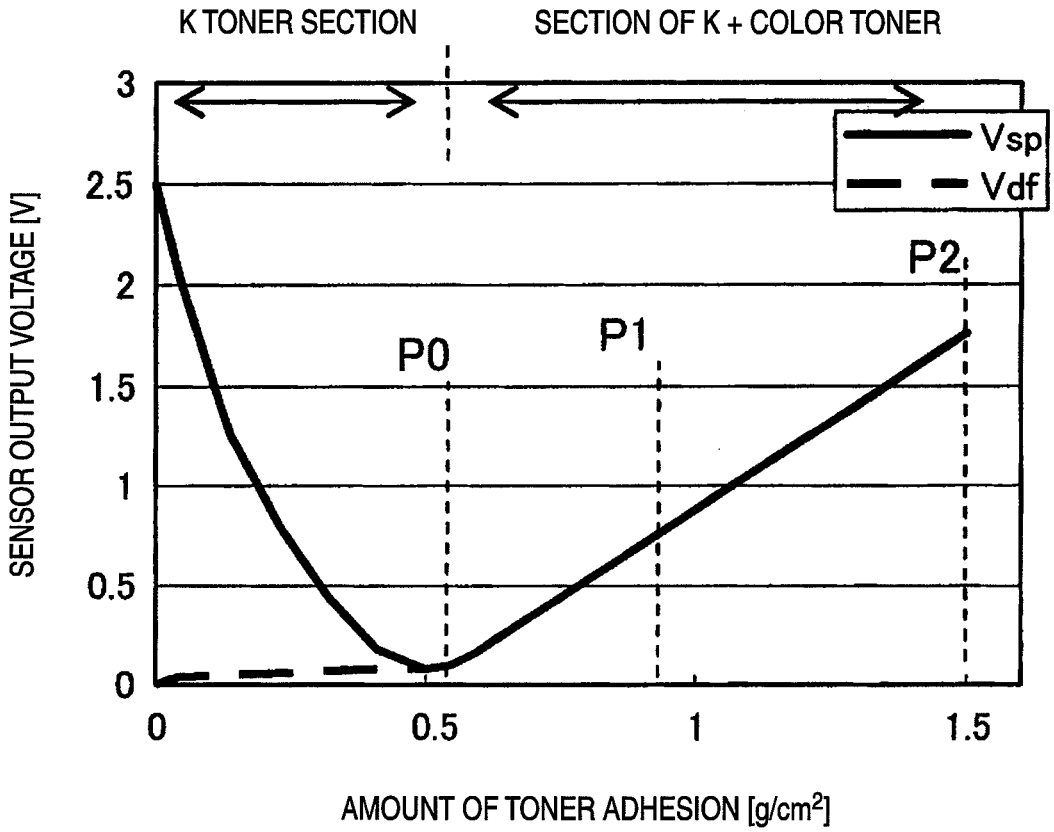
Figure 11:
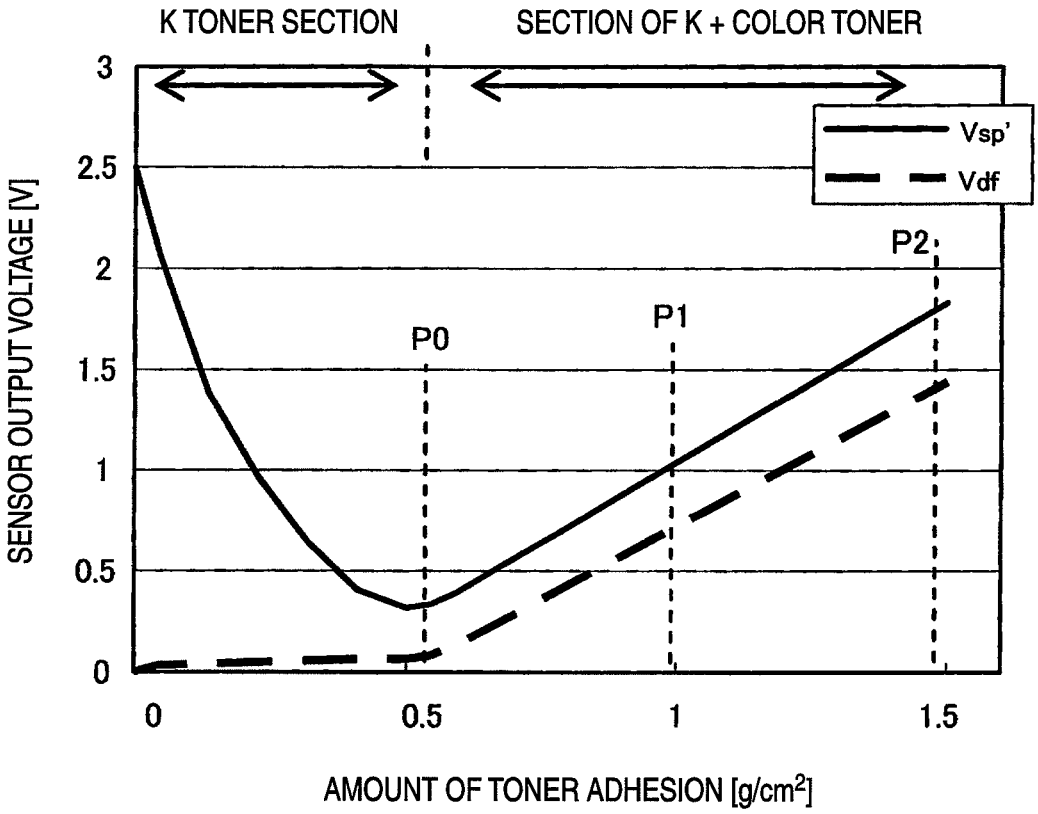
FIG. 11 is a descriptive view further specifically showing the effect.

Incidentally, in the present embodiment, only when the Vsp pertaining to the P0 patch has reached a predetermined value or less (Y in S19) as illustrated in FIG. 10C, correction parameters for causing the outputs Vsp and Vdf pertaining to the P1 patch and the P2 patch to match each other are calculated (S21). Therefore, even when only the output Vsp' is shifted to a higher value under the influence of stray light, or the like, (i.e. the influence may sometimes include the influence of so-called external light) as illustrated in, FIG. 11, for example, it is possible to make a proper correction and accurately calculate the quantity of toner adhesion.

In S19, the P0 patch is judged to be normal when the output Vsp is 20% or less of the output Vsp (2.5V in the case shown in FIGS. 8 to 11) pertaining to the surface of the conveying belt 33. The P0 patch may also be judged to be normal when (Vsp_p0−Vsp_drk)/(Vsp_belt−Vsp_drk) is 10% or less of the output Vsp. In the expression, reference symbol Vsp_p0 denotes an output Vsp pertaining to the P0 patch; reference symbol Vsp_drk denotes an output Vsp achieved when the light emitting element 93 is extinguished; and reference symbol Vsp_belt denotes an output Vsp pertaining to the surface of the conveying belt 33. Numeral values, 10% and 20%, for example, may also be changed appropriately in accordance with characteristics of the laser printer 1, and the like.

Turning back to FIG. 5, in S3 subsequent to S1, it is judged whether or not sensor sensitivity adjustment processing executed in S1 was successful. When sensor sensitivity adjustment processing has ended in a failure for reasons of occurrence of an error (N in S3), known actions, such as displaying an error message on a panel 250, are performed and the process is the simply terminated. Conversely, when the sensor sensitivity adjustment processing is successful (Y in S3), the process proceeds to S4. In S4, a plurality of locations on the surface of the conveying belt 33 is evaluated. In S5, known patch marks for density control are printed at the locations on the conveying belt 33 where the surface has been evaluated in S4. In S6, after the patch marks have been measured as in S18, it is judged in S8 whether an error is present. When the error is present (N in S8), processing is simply terminated. In contrast, when there is no error (Y in S8), the image forming conditions are adjusted in S9 using the correction unit and the density calculation unit, and processing is completed.

Processing pertaining to S9 will now be described in detail. Average values of results (outputs Vsp and Vdf) of measurement of a certain patch mark (n) are taken as Vsp_pat_ave(n) and Vdf_pat_ave(n). Average values (for a dark level) of results of measurement of the outputs Vsp and Vdf achieved at the time of extinction of the light emitting element 93 are stored as Vsp_drk_ave and Vdf_drk_ave. Average values of results of measurement of the surface at locations where the patch mark (n) are produced are stored as Vsp_belt_ave(n) and Vdf_belt ave(n). By subtracting the average values for the dark level from the respective measurement results, Vsp_belt_ave(n)−Vsp_drk_ave is calculated and stored as Vsp_belt(n); Vdf_belt_ave(n)−Vdfdrk_ave is calculated and stored as Vdf_belt(n); Vsp_pat_ave(n)−Vsp_drk_ave is calculated and stored as Vsp_pat(n); and Vdf_pat_ave(n)−Vdf_drk_ave is calculated and stored as Vdf_pat(n). Moreover, in relation to the conveying belt 33 and the patch mark, differences between the outputs Vsp and Vdf using the above correction parameters, which are stored as V_belt(n) and V_pat(n) are calculated by the following equation (corresponding to the processing of an exemplary correction unit).

$$Vsp_\text{belt}(n)-Vdf_\text{belt}(n)\times Gdf_-\text{OFFSET}=V_\text{belt}(n)$$

$$Vsp_\text{pat}(n)-Vdf_\text{pat}(n)\times Gdf_\text{OFFSET}=V_\text{pat}(n)$$

The ratio between the thus-determined V_belt(n) and V_pat(n) is then calculated by the following equation to determine a belt-patch ratio Rt_*.

$$Rt_*=V_\text{pat}(n)/\text{V_belt}(n)\ (*=\text{Black, Magenta, Cyan, Yellow})$$

Figure 12:
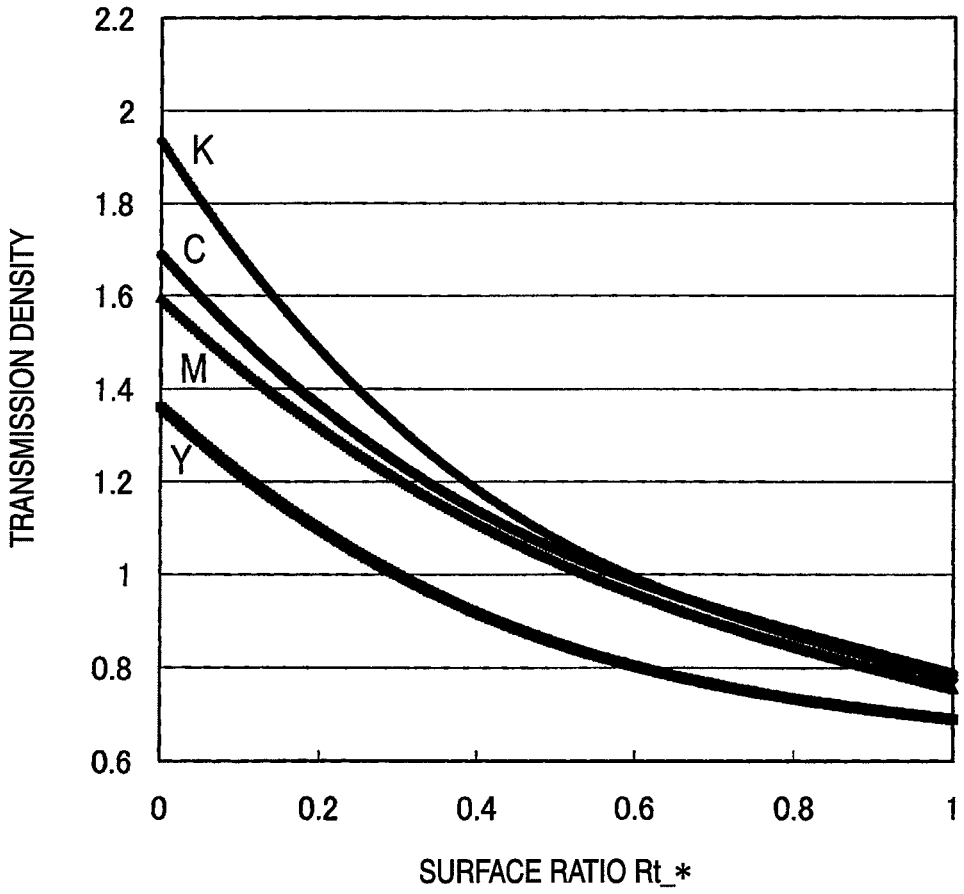
FIG. 12 is a descriptive view showing a lookup table for computing transmission density employed in density correction processing.

Specifically, Rt_K represents the belt-patch ratio for the black (K) toner, Rt_M represents the belt-patch ratio for the magenta (M) toner, Rt_C represents the belt-patch ratio for the cyan (C) toner, and Rt_Y represents the belt-patch ratio for the yellow (Y) toner. Transmission density corresponding to the belt-patch ratio Rt_* is read from the lookup table shown in FIG. 12, whereby the transmission density of the patch mark (n) can be determined (corresponding to an example of the processing of the density calculation unit). As illustrated in FIG. 12, transmission density corresponding to the belt-patch ratio Rt_* shows a different curve for each color. In S9, image forming conditions that are to serve as target densities (e.g., various bias values, and the like, for the image forming section 10) are adjusted in accordance with the thus-calculated transmission density of each of the patch marks.

In this embodiment, as mentioned previously, the influence of stray light, and the like, can preferably be eliminated from the outputs Vsp and Vdf using the correction parameters Gdf and OFFSET. Therefore, a superior image can be produced by appropriately adjusting the image forming conditions in S9. As mentioned above, transmission density is calculated from the ratio between the results of measurement of the conveying belt 33 (i.e., the belt-patch ratio).By this method, the influence of variations in components and assembly, and the like, can also be eliminated.

5. Another Embodiment of the Present Invention

The present invention shall not be limited to the above detailed embodiment and can be practiced in various forms without departing from the scope and substance of the present invention. For example, in the embodiment, the correction parameters Gdf and OFFSET are reflected in computation processing effected by software but may also be reflected in setting of circuit characteristics.

Figure 13:
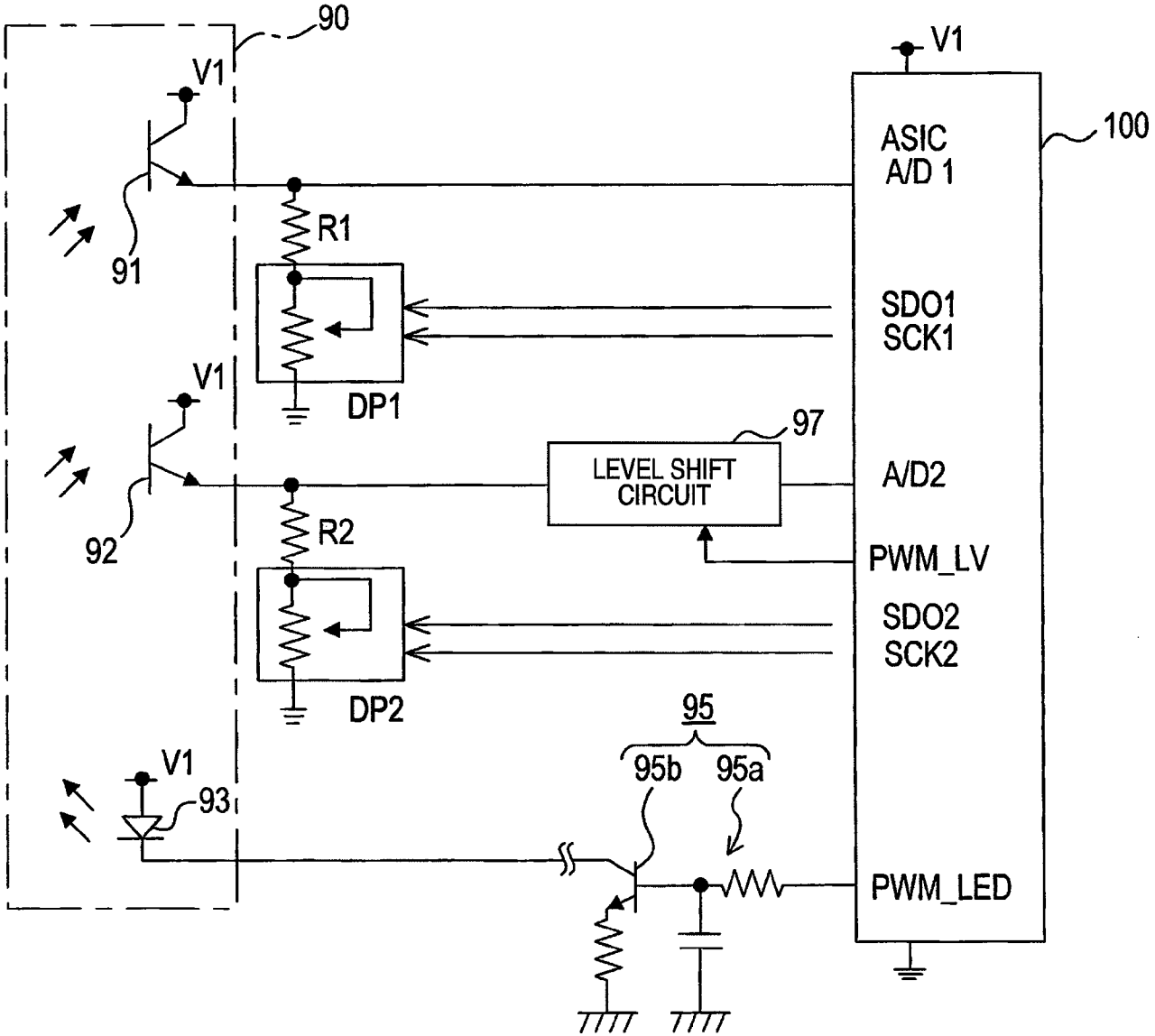
FIG. 13 is a circuit diagram showing an exemplary modification of the electrical configuration of the print density sensor.
Figure 14:
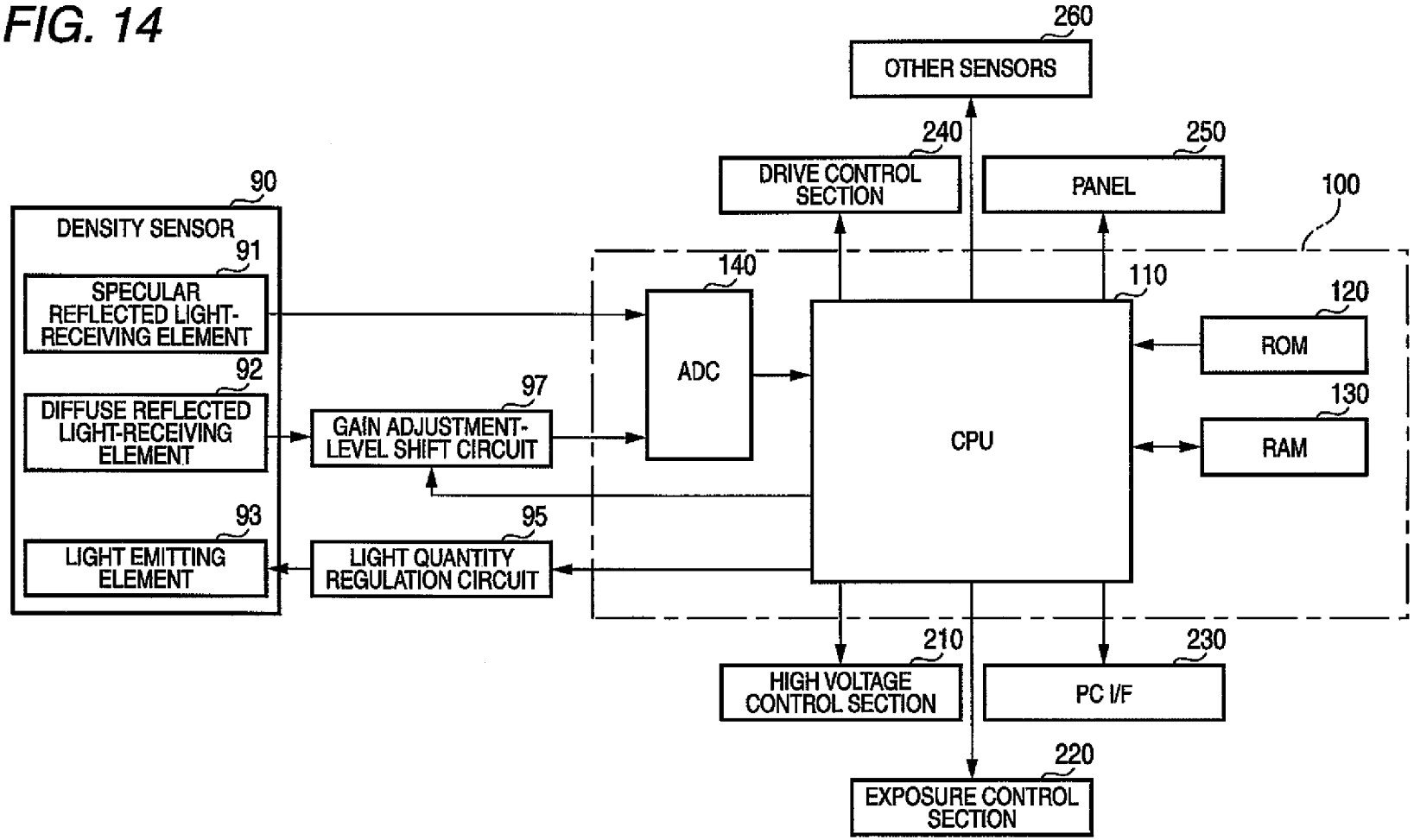
FIG. 14 is a block diagram showing a configuration of a control system corresponding to the electrical configuration.

As shown in FIGS. 13 and 14, the embodiment differs from the above embodiment in that digital potentiometers DP1 and DP2 are utilized in lieu of the variable resistors VR1 and VR2 and that output from the diffuse reflected light-receiving element 92 is input to the analogue input terminal A/D2 by way of a level shift circuit 97. Resistance values of the digital potentiometers DP1 and DP2 are regulated by serial communication signals (SCK1 and SDO1 or SCK2 and SDO2) output from the ASIC 100. The level shift circuit 97 adds or subtracts a predetermined voltage to or from the output from the diffuse reflected light-receiving element 92 in accordance with the PWM signal output from a PWM_LV port of the ASIC 100. In FIG. 13, the port that outputs the PWM signal to the light quantity regulation circuit 95 is taken as PWM_LED so as to be distinguished from the PWM_LV port.

In the thus-configured embodiment, resistance values of the digital potentiometers DP1 and DP2 are set in accordance with the correction parameter Gdf, and the voltage added or subtracted by the level shift circuit 97 is set in accordance with the correction parameter OFFSET. By this method, the influence of stray light, and the like, can be eliminated. In this case, the digital potentiometers DP1 and DP2 and the level shift circuit 97 are an example of a correction unit.

In the above embodiment, the patch mark is produced by transferring chromatic color toner, such s magenta (M) toner, onto black (K) toner transferred at 100% density level. However, patch marks may also be produced from only chromatic color toner. However, when chromatic color toner is transferred onto transferred black toner, it is possible to easily produce a patch mark in a high density area. Moreover, in the above embodiment, the correction parameters are calculated (S21) in the condition that the black patch mark (P0 patch) is in the high density area (Y in S19), enabling the correction parameters to be calculated more accurately.

In the above embodiment, the correction parameters Gdf and OFFSET are calculated by using the P1 patch and the P2 patch. However, P2 and P3 patches may also be used. Alternatively, detected values pertaining to three or more patches may also be subjected to linear approximation, to thus calculate correction parameters. Further, a coefficient GSP to be multiplied to the output Vsp may also be calculated in place of calculation of the coefficient Gdf to be multiplied to the output Vdf. Further, both the outputs Vdf and Vsp may also be multiplied by the respective coefficients. Correction parameters may also be calculated by using any of the P0 patch and the P1 patch to P3 patch. Since the influence of stray light, or the like, is also reflected in a detected value (an output Vsp, and the like) pertaining to the P0 patch, correction parameters can be calculated using, for example, the P0 patch and the P3 patch in the same manner as mentioned above. A judgment reference employed in S19 (e.g., 20% of the outputs pertaining to the surface of the conveying belt 33) is set to prevent making a negative judgment caused by the influence of such stray light, and the like.

Further, in the above embodiment, the present invention has been applied to a direct tandem color laser printer but is not limited to this type of printer. The present invention may also be applied to, for example a four-cycle electrophotographic image forming apparatus. In the above embodiment, the patch marks are produced on the conveying belt 33. However, the present invention is not limited to the embodiment. The patch marks may also be produced on a carrier element (e.g., an intermediate transfer element, a photosensitive drum, and the like) that rotate in synchronism with operation of the image forming section 10.

What is claimed is:

1. An image forming apparatus comprising:

a carrier element that carries developers;

an image forming unit that transfers the developers to the carrier element;

a patch mark generation unit that controls the image forming unit to generate, a first patch mark which is formed by adhering a layer of a developer of a first color at a 100% density level onto the carrier and superposing a layer of a developer of a second color at a 100% density level onto the layer of the developer of the first color, a second patch mark which is formed by adhering a layer of the developer of the first color at a 100% density level onto the carrier, superposing a layer of the developer of the second color at a 100% density level onto the layer of the developer of the first color, and superposing a layer of a developer of a third color at a 100% density level onto the layer of the developer of the second color, and a third patch mark which is produced at a 100% density level or less;

an irradiation unit, that irradiates light onto the carrier element;

a specular reflected light detection unit that detects the light irradiated onto the carrier element by the irradiation unit and specularly-reflected by the carrier element or the patch marks, wherein a first specular detected value is a value of the light which is reflected at the first patch mark and which is detected by the specular reflected light detection unit, a second specular detected value is a value of the light which is reflected at the second patch mark and which is detected by the specular reflected light detection unit, a third specular detected value is a value of the light which is reflected at the third patch mark and which is detected by the specular reflected light detection unit, a diffuse reflected light detection unit that detects the light irradiated onto the carrier element by the irradiation unit and diffusely-reflected by the carrier element or the patch marks, wherein a first diffuse detected value is a value of the light which is reflected at the first patch mark and which is detected by the diffuse reflected light detection unit, a second diffuse detected value is a value of the light which is reflected at the second patch mark and which is detected by the diffuse reflected light detection unit, a third diffuse detected value is a value of the light which is reflected at the third patch mark and which is detected by the diffuse reflected light detection unit, a correction unit that corrects at least one of the values detected by the specular reflected light detection unit and the values detected by the diffuse reflected light detection unit using a correction value;

a correction condition determination unit that determines the correction value for the correction unit according to a difference between the first specular detected value and the second specular detected value and a difference between the first diffuse detected value and the second diffuse detected value; and a density calculation unit that calculates a density of the third patch mark based on the third specular detected value and the third diffuse detected value, which have been corrected by the correction unit using the correction value determined by the correction condition determination unit, wherein the image forming unit determines image forming conditions based on the density calculated by the density calculation unit and forms an image.

2. The image forming apparatus according to claim 1, wherein the patch mark generation unit transfers a black developer as the developer of the first color and a developer other than black as the developer of the second color when generating the second patch mark.

3. The image forming apparatus according to claim 2, further comprising a determination unit that determines whether the value detected by the specular reflected light detection unit from the first patch mark indicates that a density of the first patch mark is at a 100% density level or not; and wherein the correction condition determination unit determines the correction value when the determination unit has determined that the value detected by the specular reflected light detection unit from the first patch mark indicates that the density level of the first patch mark is at a 100% density level.

4. The image forming apparatus according to claim 1, wherein the correction condition determination unit comprises:

a first calculation unit that calculates, based on a difference between the first specular detected value and the second specular detected value and a difference between the first diffuse detected value and the second diffuse detected value, a first correction value by which the values detected by the specular reflected light detection unit or the values detected by the diffuse reflected light detection unit are multiplied, to cause the differences to match each other; and a second calculation unit that calculates, based on a value detected by the specular reflected light detection unit and a value detected by the diffuse reflected light detection unit at at least one of the first and second patch marks, a second correction value to be added to the value detected by one of the specular reflected light detection unit and the diffuse reflected light detection unit which is corrected by the first correction value, in order to cause the value detected by one of the specular reflected light detection unit and the diffuse reflected light detection unit which is corrected by the first correction value to match the value detected by the other of the specular reflected light detection unit and the diffuse reflected light detection unit.

5. An image forming apparatus comprising:

a carrier that carries a developer image;

an image forming unit that transfers developers to the carrier so as to form the developer image;

a light source that irradiates light in a direction identical to an optical axis of the light source, the optical axis of the light source intersects with a surface of the carrier at a first position;

a first light sensor which is placed so that an angle between the optical axis of the light source and the surface of the carrier coincides with an angle between an optical axis of a first light received by the first light sensor and the surface of the carrier, and which outputs a signal indicating an intensity of the first light incoming from the direction of the optical axis of the first light;

a second light sensor which is placed in a position different from the first light sensor, wherein an optical axis of a second light received by the second light sensor and the surface of the carrier intersect at the first position, and wherein the second light sensor outputs a signal indicating an intensity of the second light incoming from the direction of the optical axis of the second light; and a controller which is coupled to the image forming unit, the light source, the first light sensor, and the second light sensor, wherein the controller calculates correction values which correct output signals of the first and second light sensors, the correction values are calculated by, controlling the image forming unit to form:

a first patch mark which is formed by adhering a layer of a developer of a first color at a 100% intensity level onto the carrier and superposing a layer of a developer of a second color at a 100% density level onto the layer of the developer of the first color; and a second patch mark which is formed by adhering a layer of the developer of the first color at a 100% density level onto the carrier, superposing a layer of the developer of the second color at a 100% density level onto the layer of the developer of the first color, and superposing a layer of a developer of a third color at a 100% density level onto the layer of the developer of the second color, controlling the irradiation unit to irradiate light onto the first patch mark and the second patch mark formed on the carrier, detecting a first specular detected value which is a value of the light reflected at the first patch mark and detected by the first light sensor, detecting a second specular detected value which is a value of the light reflected at the second patch mark and detected by the second light sensor, detecting a first diffuse detected value which is a value of the light which is reflected at the first patch mark and which is detected by the first light sensor, detecting a second diffuse detected value which is a value of the light which is reflected at the second patch mark and which is detected by the second light sensor, calculating the correction values according to a difference between the first specular detected value and the second specular detected value and a difference between the first diffuse detected value and the second diffuse detected value.

6. The image forming apparatus according to claim 5, wherein the controller controls the image forming unit in a way that the layer of the developer of the first color for each of the first and second patch marks is formed by a black developer, and the layer of the developer of the second color for each of the first and second patch marks is formed by a developer other than black.

7. The image forming apparatus according to claim 5, wherein the controller controls the image forming unit which forms the first and second patch marks comprising multi-layered developers, in a way that, the developer of the first color completely covers an area of the surface of the carrier where the patch marks are formed by the first developer, and the developer of the second color completely covers an surface of the layer of the first color.

8. The image forming apparatus according to claim 1, wherein the correction condition determination unit determines the correction value based on a ratio between the difference between the first specular detected value and the second specular detected value and the difference between the first diffuse detected value and the second diffuse detected value.

9. The image forming apparatus according to claim 5, wherein the correction value is calculated based on a ratio between the difference between the first specular detected value and the second specular detected value and the difference between the first diffuse detected value and the second diffuse detected value.

* * * * *